US006224004B1

(12) United States Patent
Kato et al.

(10) Patent No.: US 6,224,004 B1
(45) Date of Patent: May 1, 2001

(54) MILL PROVIDED WITH PARTITION WITHIN MILLING CHAMBER

(75) Inventors: Hitoshi Kato, Itami; Takeshi Yamashita, Kawanishi; Toshihito Shimoda, Toyonaka, all of (JP); Hideyuki Yoshida, Monroe, NY (US)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/339,882

(22) Filed: Jun. 25, 1999

(30) Foreign Application Priority Data

Jun. 29, 1998 (JP) ..... 10-182086

(51) Int. Cl.[7] ..... B02C 19/06
(52) U.S. Cl. ..... 241/39; 241/40
(58) Field of Search ..... 241/5, 39, 40

(56) References Cited

U.S. PATENT DOCUMENTS 4,219,164 * 8/1980 Taylor ..... 241/39
4,579,288 * 4/1986 McDermid et al. ..... 241/39
4,905,918 * 3/1990 Selles et al. ..... 241/39

FOREIGN PATENT DOCUMENTS 62-42753 * 2/1987 (JP) .

* cited by examiner

*Primary Examiner*—Mark Rosenbaum
(74) *Attorney, Agent, or Firm*—McDermott, Will & Emery

(57) ABSTRACT

A mill offers superior milling efficiency by being provided with a partition to divide a milling chamber into a first guide path and a second guide path. Particles of a milling material that have been ground at a milling area in the milling chamber are guided into a particle classifier through the first guide path, and the ground particles of the milling material that were classified by the particle classifier as requiring further milling are guided back into the milling area through the second guide path.

18 Claims, 7 Drawing Sheets

<PRIOR ART>

MILL PROVIDED WITH PARTITION WITHIN MILLING CHAMBER

This application is based on Japanese Patent Application No. 10-182086 filed in Japan on Jun. 29, 1998, the entire content of which is hereby incorporated by reference.

BACKGROUND OF THE INVENTION

1. Field of the Invention

The present invention pertains to a mill, and more particularly to a fluid-energy jet mill that grinds coarse particles using high-velocity gas.

2. Description of Related Art

In general, a fluid-energy jet mill grinds coarse particles in a milling chamber using high-velocity gas expelled from multiple nozzles. The type of fluid-energy jet mill shown in FIG. 7 in particular has conventionally been used in many cases. In this conventional fluid-energy jet mill, as shown in the drawing, the milling material is introduced into the milling chamber 3 via the feeder 4, and high-velocity gas is expelled from the nozzles 5 into the center of the nonpartitioned milling chamber 3. When this occurs, the streams of high-velocity gas expelled from the nozzles 5 collide with each other, which grinds the milling material. The ground particles of the milling material are then sorted by means of a particle classifier 2 located in the upper area of the milling chamber.

However, the conventional mill described above suffers from the problem of poor milling efficiency (milling capacity per unit time).

OBJECT AND SUMMARY

The object of the present invention is to provide an improved mill that eliminates the problem described above.

Another object of the present invention is to provide a mill that offers superior milling efficiency.

These objects are attained by means of a mill comprising:

a milling chamber;

an expelling device that expels high-velocity gas into the milling chamber to grind the milling material in a prescribed milling area;

a particle classifier that classifies the ground particles of the milling material and returns back into the milling chamber the particles that are not of the desired size, said particle classifier being located such that it faces the milling chamber; and a partition that divides the milling chamber into a first guide path that guides the particles of the milling material that are ground at the milling area into the particle classifier and a second guide path that guides back into the milling area the ground particles of the milling material classified by the particle classifier as requiring further milling.

In such a mill, the expelling device may be situated such that it expels high-velocity gas into the center of the milling chamber. In this case, the mill may have multiple expelling devices so that the milling material may be ground by means of the collisions of streams of high velocity gas expelled from the multiple expelling devices into the center of the milling chamber. Further, such a mill may be equipped with a member against which the high-velocity gas expelled from the expelling devices collides, such that the milling material is ground by means of the collision between the high-velocity gas expelled from the expelling devices and the member.

In such a mill, the expelling device may be situated such that the high-velocity gas is expelled toward the surrounding wall of the milling chamber. In this case, the mill may be equipped with a member against which the high-velocity gas expelled from the expelling device collides, such that the milling material is ground through the collision between the high-velocity gas expelled from the expelling device and the member.

In such a mill, the expelling device may have an opening facing the second guide path such that the milling material received from the opening are expelled together with the high-velocity gas.

Such a mill may furthermore have a collecting member that collects the milling material and guides it to the opening of the expelling device.

These objects are also attained by means of a mill comprising:

a cylindrical milling chamber;

multiple nozzles that expel high-velocity gas into the center of the milling chamber, said multiple nozzles each having an opening that receives the milling material and grinding the milling material by expelling it together with the high-velocity gas;

a particle classifier that classifies the ground particles of the milling material and returns back into the milling chamber the particles that are not of the desired size, said particle classifier being located at the upper area of the milling chamber; and a cylindrical partition that is situated inside the milling chamber such that its axis is essentially aligned along the axis of the milling chamber, wherein the ground particles of the milling material reach the particle classifier through the interior of the partition, and the ground particles classified by the particle classifier as requiring further milling are led to the nozzle openings passing outside the partition.

In such a mill, it is preferred for the partition to have an inner diameter that is one-half to two-thirds of the inner diameter of the milling chamber.

Such a mill may furthermore be equipped with a member against which the high-velocity gas expelled from the multiple nozzles collides.

Such a mill may furthermore be equipped with hoppers that collect the milling material and guide it to the nozzle openings.

These objects may furthermore be attained by means of a mill comprising:

a cylindrical milling chamber;

multiple nozzles that expel high-velocity gas toward the surrounding wall of the milling chamber, said multiple nozzles each having an opening that receives the milling material and grinding the milling material by expelling it together with the high-velocity gas;

a particle classifier that classifies the ground particles of the milling material and returns back into the milling chamber the particles that are not of the desired size, said particle classifier being located in the upper area of the milling chamber; and a cylindrical partition that is situated inside the milling chamber such that its axis is essentially aligned along the axis of the milling chamber, wherein the ground particles of the milling material reach the particle classifier through the outside of the partition and the ground particles classified by the particle classifier as requiring further milling are led to the nozzle openings passing through the interior of the partition.

Such a mill may furthermore be equipped with members against which the high-velocity gas expelled from the multiple nozzles collides.

Such a mill may furthermore be equipped with hoppers that collect the milling material and guide it to the nozzle openings.

In the various forms of mill described above, it is best if the expelling devices, i.e., the nozzles, comprise Laval-type nozzles.

BRIEF DESCRIPTION OF THE DRAWINGS

These and other objects and features of the present invention will become clear from the following description taken in conjunction with the preferred embodiments thereof with reference to the accompanying drawings, in which:

FIG. 1(*b*) is a cross-sectional view of the mill shown in FIG. 1(*a*) cut across the (*a*) line.

FIG. 2(*b*) is a cross-sectional view of the mill shown in FIG. 2(*a*) cut across the (*a*) line.

FIG. 3(*b*) is a cross-sectional view of the mill shown in FIG. 3(*a*) cut across the (*a*) line.

FIG. 4(*b*) is a cross-sectional view of the mill shown in FIG. 4(*a*) cut across the (*a*) line.

FIG. 5(*b*) is a cross-sectional view of the mill shown in FIG. 5(*a*) cut across the (a) line.

FIG. 6(*b*) is a rough vertical cross-sectional view in which two Laval-type nozzles are aligned in a straight line.

DETAILED DESCRIPTION OF THE PREFERRED EMBODIMENTS

The preferred embodiments of the present invention will be explained below with reference to the drawings. However, the present invention is not limited to the examples shown below.

Figure 1A:
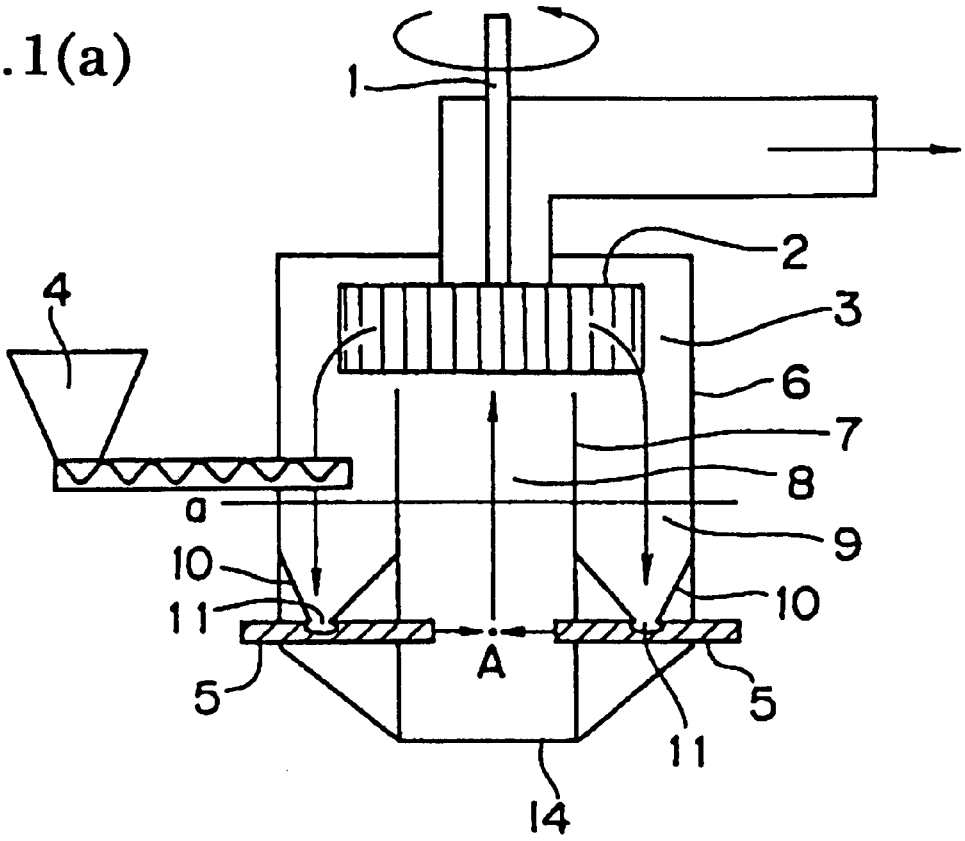
FIG. 1(*a*) is a rough cross-sectional view of one example of the mill of the present invention.
Figure 1B:
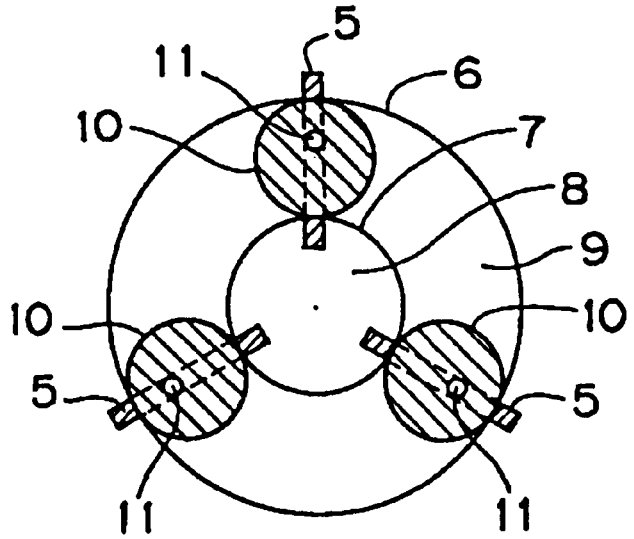

One example of the mill of the present invention, in which nozzles are mounted in the surrounding wall of the milling chamber such that they expel gas into the center of the milling chamber, is shown in FIGS. 1(*a*) and 1(*b*). FIG. 1(*a*) shows a rough vertical cross-sectional view of such a mill, and FIG. 1(*b*) shows a cross-sectional view of the mill shown in FIG. 1(*a*) cut along the (*a*) line.

This mill is equipped with a cylindrical separating plate 7 that functions as a partition to divide the milling chamber into a milled material guide path 8 and a coarse particle guide path 9. The separating plate 7 has a connecting opening (not shown in the drawings) at the bottom that connects the milled material guide path 8 and the coarse particle guide path 9, and is formed above the base 14. Nozzles 5 that operate as the expelling devices penetrate the separating plate 7 so that they may expel the high-velocity gas into the center of the milling chamber.

When a milling material is actually milled, the milling material is introduced into the coarse particle guide path 9 from a feeder 4. The milling material that is collected by means of hoppers 10 passes through supply openings 11 and is conveyed and propelled by means of the high-velocity gas in the nozzles 5. It is then milled in the center of the milling chamber (the milling area). On the other hand, the milling material that was not collected by the hoppers 10 reaches the milling area via the connecting opening at the bottom of the separating plate 7, and is subjected to milling. A rising air current is present in the milled material guide path 8 of the milling chamber 3. The milled particles (the milled material) are conveyed to the top of the milling chamber 3 (a classifying area) via this rising air current, and are classified by a particle classifier 2. For the particle classifier 2, a horizontal rotor-type unit that is driven to rotate by means of a rotor shaft 1 is preferred. The milled material that is lifted by the rising air current enters the interior of the particle classifier from its bottom surface. Through the horizontal rotation of the particle classifier rotor, the milled material that are not of the desired diameter (particles having a diameter larger than the desired diameter), i.e., coarse particles are returned from the interior of the particle classifier through its side into the milling chamber, and particles having a diameter equal to or smaller than the desired diameter are conveyed for subsequent processing by means of an air pipe that is connected to the particle classifier. As this occurs, because a descending air current is present in the coarse particle guide path 9, the coarse particles that were classified by the particle classifier 2 as requiring further milling are conveyed once more to the milling area by means of the descending air current together with the milling material supplied by the feeder 4.

The separating plate 7 may have any configuration, so long as it can effectively separate the milled material guide path 8 from the coarse particle guide path 9. However, it is preferred that it have a cylindrical configuration, as shown in FIGS. 1(*a*) and 1(*b*), and that it be situated inside the milling chamber such that its axis is essentially aligned with the axis of the milling chamber. There are no particular limitations regarding the size of the separating plate so long as the plate can effectively separate one guide path from the other, but it is preferred that the separating plate have a height such that the space between the particle classifier located in the upper area of the milling chamber and the top edge of the separating plate is approximately between 1 mm and 5 mm, and that the separating plate have an inner diameter that is one-half to two-thirds of the inner diameter of the milling chamber. There are no particular limitations regarding the material for the separating plate, but stainless steel, for example, works well.

Each nozzle 5 has a supply opening 11 between a surrounding wall 6 and the separating plate 7, i.e., facing the coarse particle guide path 9, so that the milling material or the classified coarse particles requiring further milling may be directly conveyed and propelled to the milling area. However, it is also acceptable if no supply openings are used and the milling material and the coarse particles are conveyed to the milling area via only the connecting openings at the bottom of the separating plate. The connecting openings should be of a size that prevents the milling material or the coarse particles from remaining stagnant at the bottom between the surrounding wall 6 and the separating plate 7 and that allows the separating plate to be supported.

Figure 2A:
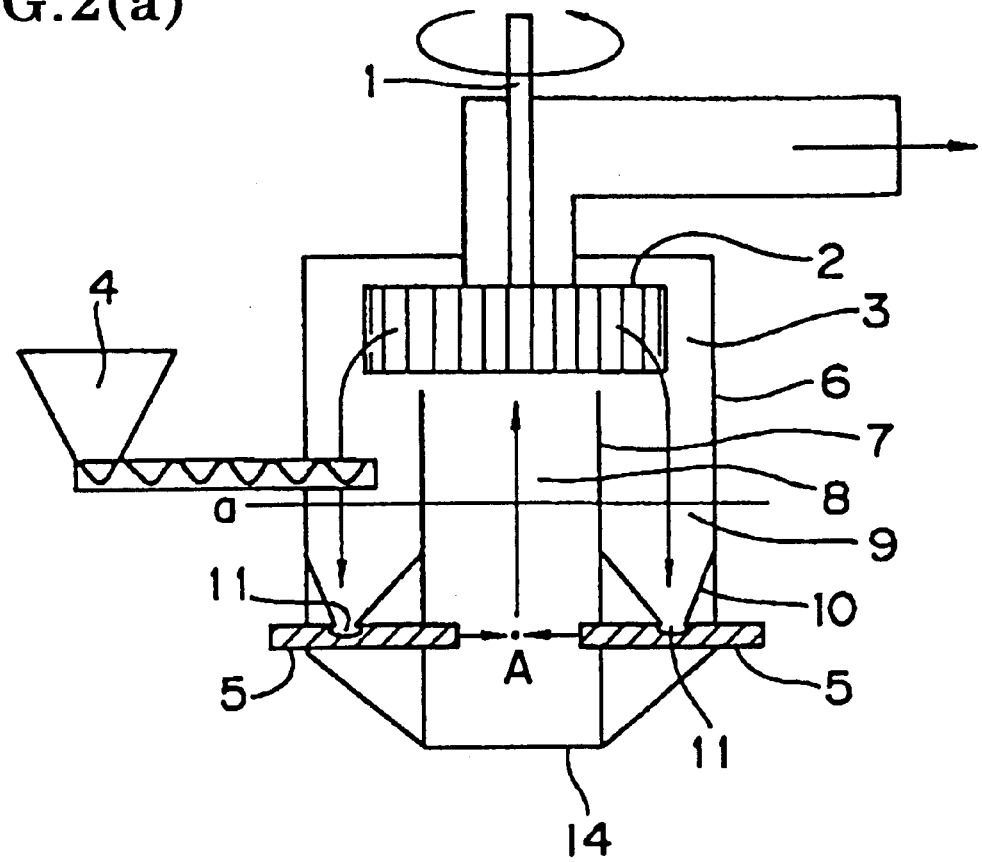
FIG. 2(*a*) is a rough cross-sectional view of one example of the mill of the present invention in which the configuration of the hoppers of the mill shown in FIG. 1(*a*) has been changed.
Figure 2B:
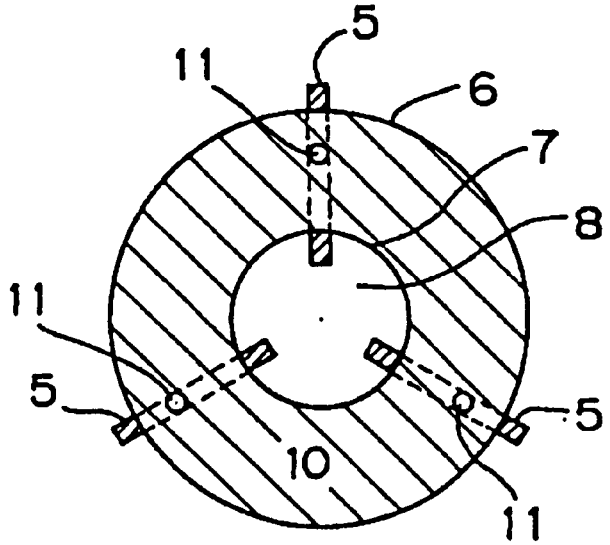

When forming the supply openings 11 in the nozzles, it is preferred from the standpoint of increased milling efficiency that hoppers 10, which operate as collecting members, be located at the supply openings 11 as shown in FIGS. 1(*a*) and 1(*b*). Here, the three hoppers 10 have a funnel shape, but their configuration is not limited to this. For example, a configuration that comprises multiple hoppers combined together and that closes off the coarse particle guide path, i.e., the configuration shown in the cross-sectional view of FIG. 2(*b*), may be used, so that all the particles that pass through the coarse particle guide path 9 are conveyed and propelled to the milling area from the supply openings 11. Milling efficiency improves significantly through the use of such a hopper. FIG. 2(*a*) shows a rough vertical cross-sectional view of one embodiment of the mill of the present invention in which an integral hopper 10 is situated such that it closes off the coarse particle guide path. FIG. 2(*b*) shows a cross sectional view of the mill shown in FIG. 2(*a*) cut along the (*a*) line. The construction of the mill shown in FIGS. 2(*a*) and 2(*b*) is the same as that of the mill shown in FIGS. 1(*a*) and 1(*b*) except for the use of the integral hopper.

Three nozzles are used in the mills shown in FIGS. 1(*a*) and 1(*b*) and FIGS. 2(*a*) and 2(*b*), but the number of nozzles is not limited to three. From the standpoint of increased milling efficiency, the number of nozzles should be between two and eight, and preferably between two and four. Where multiple nozzles are used, it is preferred that they be distanced equally from one another and arranged in a symmetrical fashion.

Figure 3A:
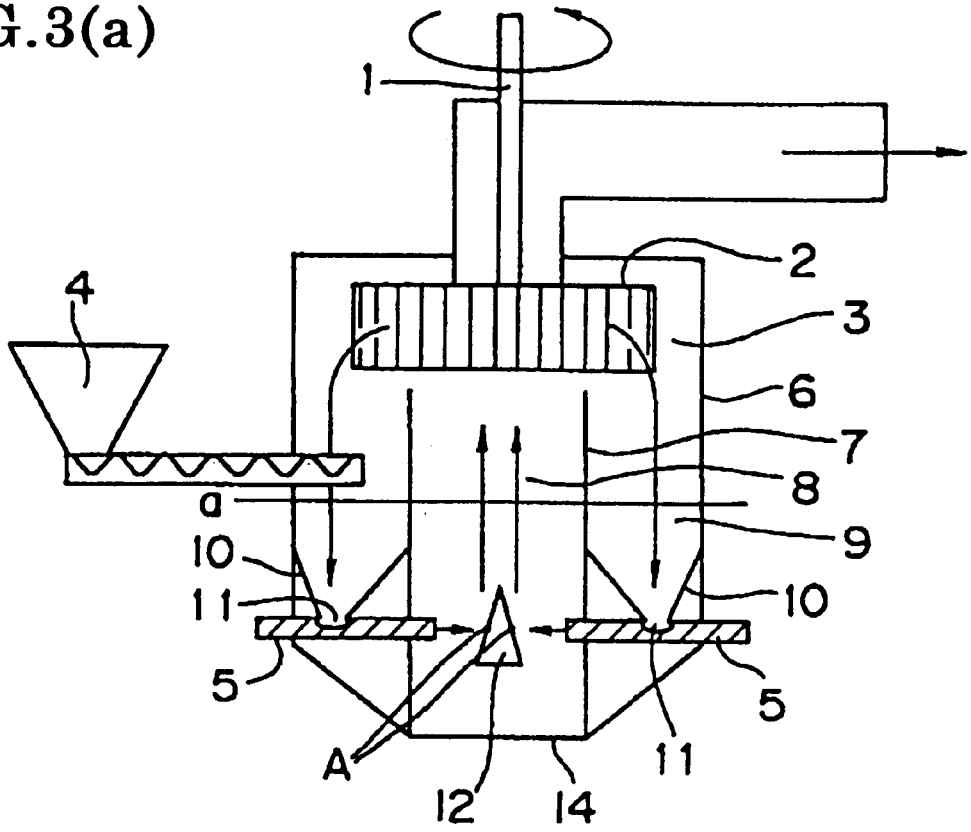
FIG. 3(*a*) is a rough cross-sectional view of one example of the mill of the present invention in which a collision member is present.
Figure 3B:
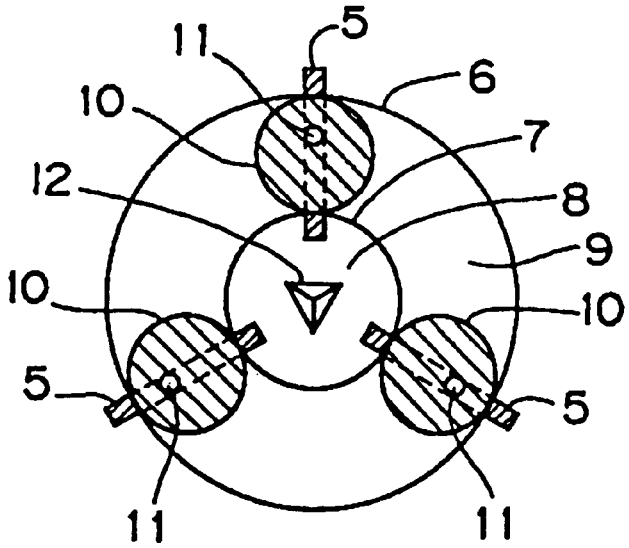

Further, FIGS. 3(*a*) and 3(*b*) show another example of a preferred embodiment of the mill of the present invention. FIG. 3(*a*) shows a rough vertical cross sectional view of one example of the mill of the present invention, while FIG. 3(*b*) shows a cross-sectional view of the mill shown in FIG. 3(*a*) cut along the (*a*) line. The construction of the mill shown in FIGS. 3(*a*) and 3(*b*) is the same as that of the mill shown in FIGS. 1(*a*) and 1(*b*) except that a collision member 12 having a equilateral triangular pyramid shape is located at the center of the milling chamber, such that the high-velocity gas expelled from the nozzles collides with the collision member. The milling efficiency may be further improved through the presence of a collision member situated in this fashion.

The collision member is not limited to an equilateral triangular pyramid configuration. It may be of any configuration, including a rectangular pyramid, cone, sphere, semi-sphere, rectangular pillar or cylinder, but it is preferred that it have a configuration that allows the high-velocity gas that collides with it to flow upward so as to contribute to the rising air current in the milled material guide path. Consequently, a flat plate slanted upward so that the colliding high-velocity gas may flow upward may be used, or the nozzles may be slanted upward. The angle between the nozzle axes and the surface of the collision member should be between 20 and 80 degrees, and preferably between 40 and 65 degrees.

For the material of the collision member, it is preferred that a material that is relatively rigid and resistant to frictional wear be used, such as ceramic, ultra-rigid alloy or nitride steel. Easily deformable stainless steel or iron may be used with a coating of one of the aforementioned materials.

Figure 4A:
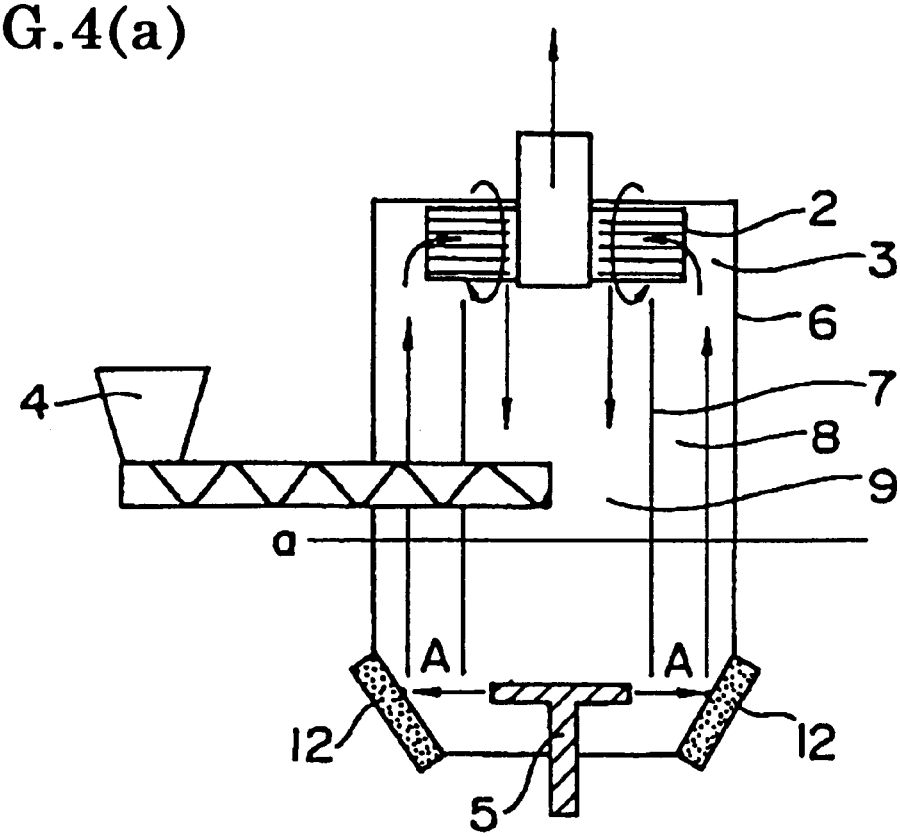
FIG. 4(*a*) is a rough cross-sectional view of one example of the mill of the present invention in which the nozzles are located in the center of the milling chamber.
Figure 4B:
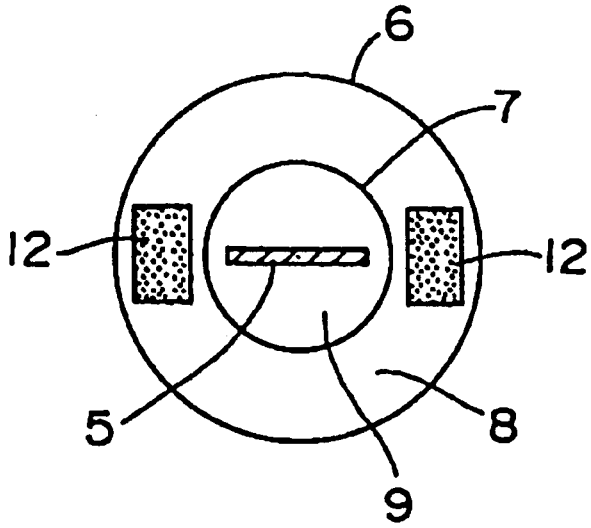

As another example of an embodiment of the mill of the present invention, a mill in which the nozzles are located in the center of the milling chamber such that they expel gas toward the surrounding wall of the milling chamber is provided as shown in FIGS. 4(*a*) and 4(*b*). FIG. 4(*a*) shows a rough vertical cross-sectional view of an example of the mill of the present invention in which the nozzles are situated in the center of the milling chamber, while FIG. 4(*b*) shows a cross-sectional view of the mill shown in FIG. 4(*a*) cut along the (*a*) line. In the mill shown in FIGS. 4(*a*) and 4(*b*), the nozzles 5 are located in the center of the milling chamber such that they expel high-velocity gas toward the surrounding wall of the milling chamber, and the collision members 12 are located inside the milling chamber such that the high-velocity gas expelled from the nozzles collides with them. Consequently, the path between the separating plate 7 and the surrounding wall 6 becomes the milled material guide path 8 to lead the milling material that has been ground at the milling areas (the areas near the collision members 12) to the particle classifier, and the path inside the separating plate 7 becomes the coarse particle guide path 9 to lead the classified coarse particles requiring further milling downward to the milling areas. The separating plate 7 is formed such that it does not hinder the expulsion of high-velocity gas from the nozzles 5 toward the collision members 12. The feeder 4 extends to the inner path that is separated by means of the separating plate 7.

When the milling material is actually ground, it is introduced into the coarse particle guide path 9 by means of the feeder 4. The milling material thus introduced falls near the nozzles via a circulating air current, is conveyed and propelled by high-velocity gas, and is then ground through collision with the collision members 12. A rising air current exists in the milled material guide path 8 in the milling chamber 3, so that the ground particles (the milled material) are conveyed to the upper area of the milling chamber 3 (a classifying area) via the rising air current and are classified by the particle classifier 2. For the particle classifier 2, a vertical rotor-type unit is preferred. The milled material that has risen due to the rising air current enters the interior of the particle classifier through its side. Coarse particles are returned back into the milling chamber via the vertical rotation of the particle classifier rotor, while particles having a diameter equal to or smaller than the desired diameter are conveyed for subsequent processing by means of an air pipe that is connected to the particle classifier. As this occurs, a descending air current is present in the coarse particle guide path 9, so that the coarse particles that were classified by the particle classifier 2 as requiring further milling are conveyed once more to the milling areas together with the milling material supplied by the feeder 4 by means of the descending air current.

The same materials as mentioned in connection with the previous embodiment may be used for the materials of the separating plate 7, but it is preferred that the separating plate 7 have a configuration and size that secure paths for the gas flow so that the expulsion of high-velocity gas from the nozzles 5 toward the collision members 12 is not hindered. Where two nozzles aligned in a straight line are used, as shown in FIG. 4(*b*), it is preferred that the separating plate 7 have openings so as not to negatively affect the expulsion of high-velocity gas, and that connecting openings be present at the bottom of the separating plate, said connecting openings having a size that prevents stagnation of the milling material and coarse particles and maintains the separating plate, as in the case where the nozzles are mounted in the surrounding wall such that the nozzle openings face the center of the milling chamber. In this case, the openings to secure the paths for the high-velocity gas flow may have an arched configuration, in which the separating plate is connected to the base, and the connecting openings may be formed at the bottom of the parts of the separating plate that are connected to the base.

Two nozzles are used in the mill of this embodiment, but the number of nozzles is not limited to two. Where multiple nozzles are used, it is preferred that they be distanced equally from one another and arranged in a symmetrical fashion, and in that case, the same number of collision members as the number of the nozzles are located at positions to correspond to each nozzle. The configuration of the collision members should preferably allow the colliding high-velocity gas to flow upward to promote the rising air current in the milled material guide path, as in the case of the previous embodiment.

Figure 5A:
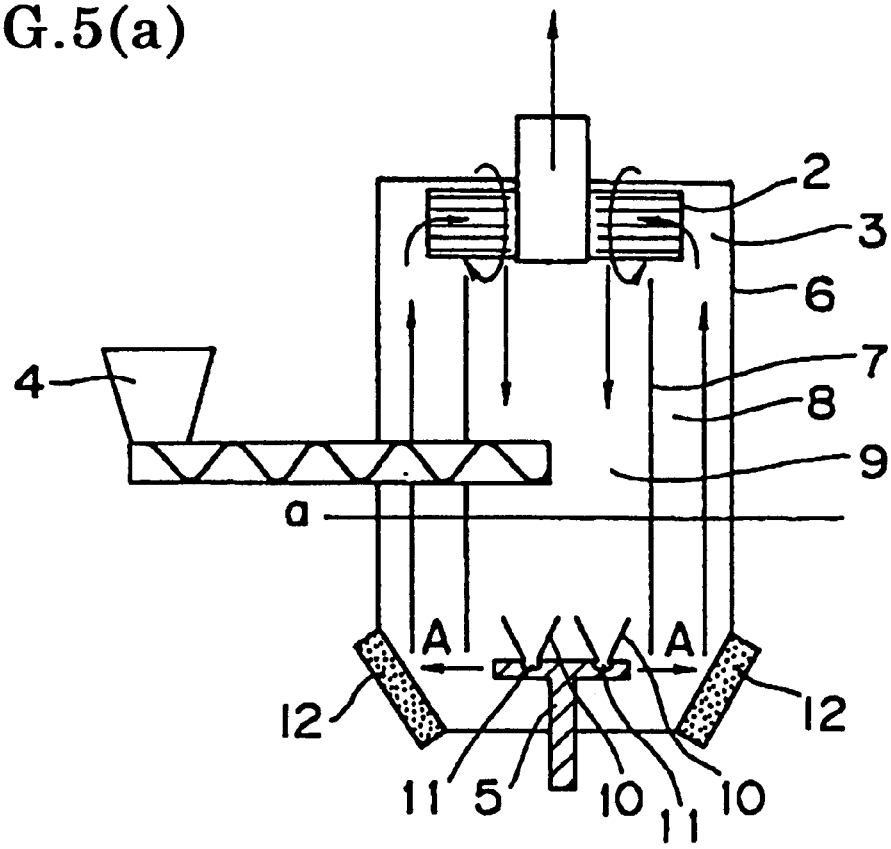
FIG. 5(*a*) is a rough cross-sectional view of one example of the mill of the present invention in which the nozzles of the mill shown in FIG. 4(*a*) have openings and hoppers.
Figure 5B:
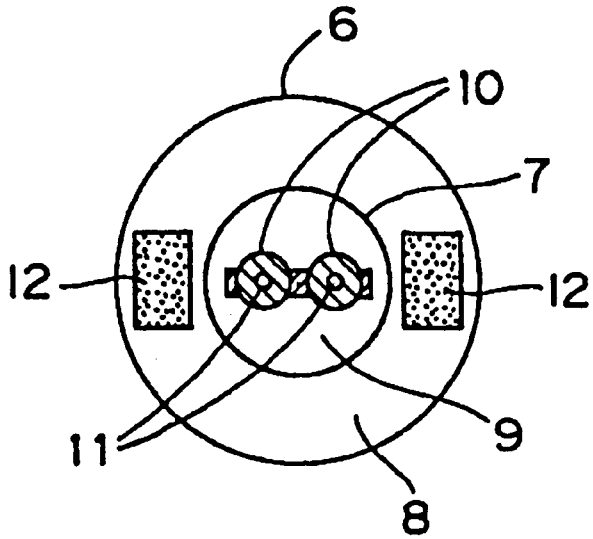

FIGS. 5(*a*) and 5(*b*) show another mill comprising a modified example of the mill shown in FIGS. 4(*a*) and 4(*b*). FIG. 5(*a*) shows a rough vertical cross-sectional view of one example of the mill of the present invention, and FIG. 5(*b*) shows a cross-sectional view of the mill shown in FIG. 5(*a*) cut along the (*a*) line. The construction of the mill shown in FIGS. 5(*a*) and 5(*b*) is the same as that of the mill shown in FIGS. 4(*a*) and 4(*b*), except that each nozzles has a supply opening 11 and a hopper 10 at the supply opening. In the same manner as in the case where the nozzles are mounted in the surrounding wall such that the nozzle openings face the center of the milling chamber, the milling efficiency may be further increased by forming supply openings in the nozzles and locating hoppers at the supply openings.

Figure 6A:
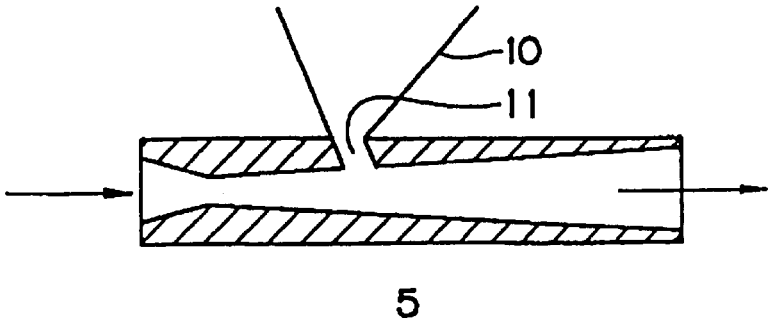
FIG. 6(*a*) is a rough vertical cross-sectional view of a Laval-type nozzle having opening and a hopper.
Figure 6B:
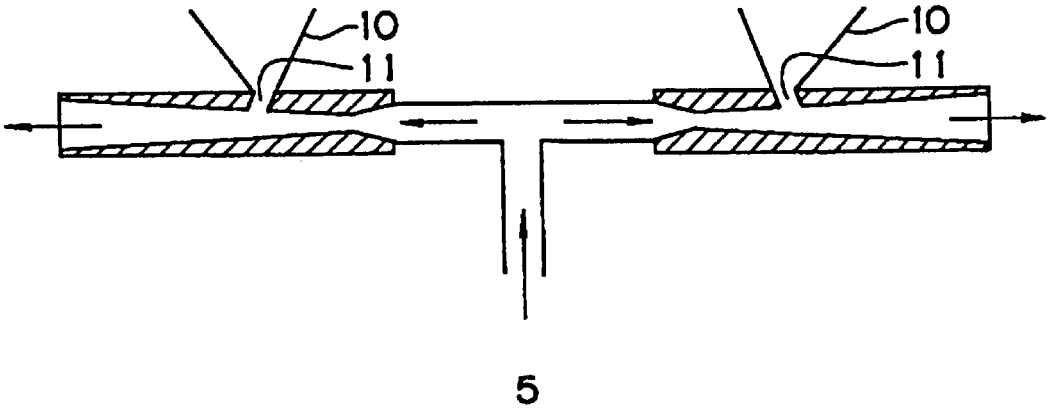
Figure 7:
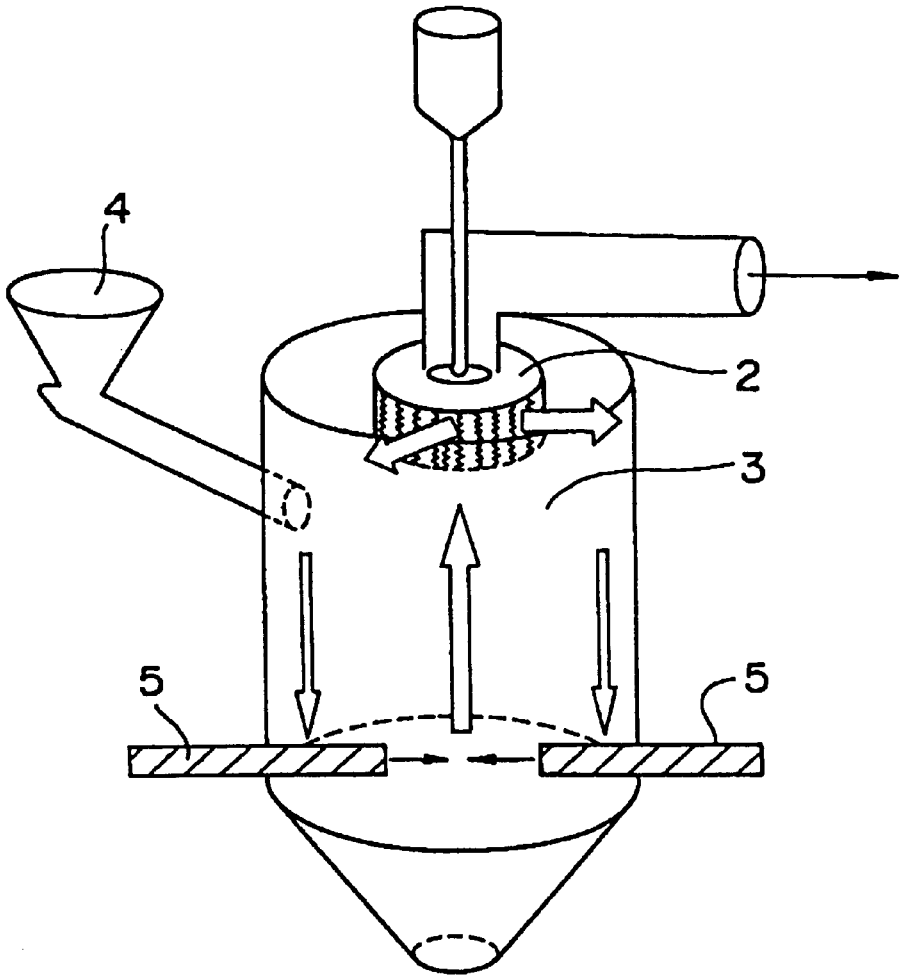
FIG. 7 is a rough perspective view showing the construction of the conventional mill.

For the nozzles used in the various embodiments described above, the well known nozzles that are conventionally used in the fluid-energy jet mill may be used, but from the standpoint of milling efficiency, it is preferred that Laval-type nozzles be used. A Laval-type nozzle is characterized in that it has an inlet for compressed air, a part that is narrower than the inlet and an opening that tapers outward from the narrow part, as shown in FIG. 6(*a*). Where two Laval-type nozzles are aligned in a straight line, they are used in the form shown in FIG. 6(*b*). FIGS. 6(*a*) and 6(*b*) show rough cross-sectional views of a Laval-type nozzle and Laval-type nozzles, respectively, having a supply opening and a hopper.

There are no particular limitations regarding the inner diameter of the expelling opening of the nozzle, but it should be between 1 mm and 5 mm, and preferably between 2 mm and 4 mm. For the high-velocity gas expelled from the nozzles, air, $N_2$, $CO_2$, etc. are used. Its compression pressure (expulsion pressure) should be between 3 and 10 kg/cm$^2$, and preferably between 6 and 10 kg/cm$^2$.

It is preferred that the particles having a diameter equal to or smaller than the desired diameter that are ground by any of the mills of these embodiments and classified by the particle classifier be conveyed to a cyclone in order to further classify the fine particles. More specifically, (1) the particles having a diameter equal to or smaller than the desired diameter that are classified by the particle classifier 2 are conveyed to the cyclone via an air pipe, and (2) minute particles having an extremely small diameter are removed in the cyclone by means of a fine powder aspirator so that only particles having the desired diameter (the product) may be collected. In the explanations provided above, mills having a feeder that introduces the milling material through an inlet which is separate from the nozzles were used, but the present invention is not limited to this implementation and may be applied in mills that directly insert the milling material (the raw material) into the nozzles.

These mills are useful when coarse particles having a volume average diameter of 10 to 1,000 $\mu$m (the milling material) are to be ground further. While there are no limitations regarding the milling material, it is preferred that it include a resin as its main constituent component. Therefore, the mills of these embodiments may be favorably used for the fine milling of toner comprising at least a resin and a coloring agent.

Using the mill of the present invention, by setting the number of rotations of the motor to drive the particle classifier rotor, the size of the slits of the particle classifier rotor, the high-velocity gas flow rate and the aspiration rate of the fine powder aspirator, particles having a volume average diameter of 10 to 1,000 $\mu$m (the milling material) may be further ground to particles of a volume average diameter of 10 $\mu$m or less and even to 5 $\mu$m or less. Furthermore, the particles obtained using the mill of the present invention have a notably sharp particle size distribution in comparison with that of the particles obtained by means of the conventional mill, and this distribution may be controlled such that 80 percent by weight of the particles obtained fall within the volume average diameter range of 5 to 10 $\mu$m.

In addition, the mill of the present invention may be easily manufactured simply by adding a separating plate in the conventional fluid-energy jet mill, and consequently, the manufacturing cost may be substantially minimized, providing an economic advantage as well.

FIRST EXAMPLE

Styrene-butylene methacrylate co-polymer coarse particles having a volume average diameter of 100 $\mu$m (average molecular weight of approximately 200,000) were ground using a milling/classification system comprising a mill shown in FIGS. 1(*a*) and 1(*b*) and a cyclone (not shown in the drawings). The coarse particles were supplied in a continuous and consistent fashion so that the amount of coarse particles inside the milling chamber would not be too small or too large. The volume average particle diameter of the milled material obtained was 10.0 $\mu$m and the feed amount was 9.0 kg/h. The milling and classification conditions used are shown below. The inner diameter of the mill was 450 mm and its height was 500 mm.

Milling Conditions

Separating plate: Having a cylindrical configuration; inner diameter of the horizontal cross-section of the separating plate: 250 mm; connecting openings present at bottom (diameter 10 mm, 40 openings at equal distances); space between the classifier and the top edge of the separating plate: 2.5 mm.

Collision member: None

Nozzles: Three nozzles (placed horizontally in equidistant fashion); inner diameter: 5 mm, compressed air pressure: 6 kg/cm$^2$; distance from nozzle tip to collision point A: 40 mm; Laval-type milling nozzles Classification Conditions Number of rotations of classifier rotor: 5,000 rpm Aspiration rate: 10 m$^3$/min.

SECOND EXAMPLE

Other than that the mill shown in FIGS. 3(*a*) and 3(*b*) was used, a milled material having a volume average particle diameter of 8.0 $\mu$m was obtained based on a feed amount of 12.0 kg/h in the same manner as in the first example. The milling conditions used are shown below. The classification conditions used were the same as in the first example.

Milling conditions

Separating plate: Of a cylindrical configuration; inner diameter of the horizontal cross-section of the separating plate: 250 mm; connecting openings present at the bottom (diameter 10 mm, 40 openings at equal distances); space between the classifier and the top edge of the separating plate: 2.5 mm.

Collision member: Of an equilateral triangular pyramid configuration; angle between the nozzle axes and the collision member surface: 45 degrees; stainless steel Nozzles: Three nozzles (horizontally located in equidistant fashion); inner diameter: 5 mm, compressed air pressure: 6 kg/cm$^2$; distance from nozzle tip to collision point A: 40 mm; Laval-type milling nozzles

THIRD EXAMPLE

Other than that the mill shown in FIGS. 4(*a*) and 4(*b*) was used, a milled material having a volume average particle diameter of 8.0 $\mu$m was obtained based on a feed amount of 10.0 kg/h in the same manner as in the first example. The milling conditions used are shown below. The classification conditions used were the same as in the first example.

Milling conditions

Separating plate: Of a cylindrical configuration; inner diameter of the horizontal cross-section of the separating plate: 250 mm; space between the classifier and the top edge of the separating plate: 2.5 mm. (The separating plate has arch-shaped openings to secure paths for the flow of the high-velocity gas from the nozzles. Connection openings (having a diameter of 10 mm) are formed in equidistant fashion at the bottom of the separating plate that is connected to the base.)

Collision member: flat plate; angle between the nozzle axes and the collision member surfaces: 45 degrees; stainless steel Nozzles: Two nozzles (horizontally located in equidistant fashion); inner diameter: 5 mm, compressed air pressure: 6 kg/cm$^2$; distance from nozzle tip to collision point A: 40 mm; Laval-type milling nozzles

FOURTH EXAMPLE

Other than that the mill shown in FIGS. 5(*a*) and 5(*b*) was used, a milled material having a volume average particle diameter of 8.0 $\mu$m was obtained based on a feed amount of 12.0 kg/h in the same manner as in the first example. The milling conditions used are shown below. The classification conditions used were the same as in the first example.

Milling conditions

Separating plate: Of a cylindrical configuration; inner diameter of the horizontal cross-section of the separating plate: 250 mm; space between the classifier and the top edge of the separating plate: 2.5 mm. (The separating plate has arch-shaped openings to secure paths for the flow of the high velocity gas from the nozzles. Connection openings (having a diameter of 10 mm) are formed in equidistant fashion at the bottom of the separating plate that is connected to the base.)

Collision members: flat plates; angle between nozzle axes and collision member surfaces: 45 degrees; stainless steel Nozzles: Two nozzles (horizontally located in equidistant fashion); inner diameter: 5 mm, compressed air pressure: 6 kg/cm$^2$; distance from nozzle tip to collision point A: 40 mm; Laval-type milling nozzles

COMPARATIVE EXAMPLE

Other than that no separating plate was used and the nozzles were equipped with no supply openings or hoppers, a milled material having a volume average particle diameter of 8.0 $\mu$m was obtained based on a feed amount of 5.0 kg/h in the same manner as in the first example.

Milling conditions

Separating plate: None

Collision member: None

Nozzles: Three nozzles (horizontally located in equidistant fashion); inner diameter: 5 mm, compressed air pressure: 6 kg/cm$^2$; distance from nozzle tip to collision point A: 40 mm; Laval-type milling nozzles As can be seen from the examples and the comparative example shown above, the milling efficiency of the fluid-energy jet mill may be improved by using a separating plate. In addition, the milling efficiency of the mill can be further improved by using a collision member or members. Moreover, the milling efficiency of the mill is further improved by forming a supply opening in each nozzle and locating a hopper at each supply opening.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A mill comprising:

a milling chamber;

an expelling device that expels high-velocity gas into the milling chamber, said expelling device having an opening that receives a milling material and grinding the milling material by expelling it together with the high-velocity gas;

a particle classifier that classifies the ground particles of the milling material and returns back into the milling chamber the ground particles of the milling material that are not of desired size, said particle classifier being located such that it faces the milling chamber; and a partition that divides the milling chamber into a first guide path that guides the particles of the milling material that are ground at the milling area into the particle classifier and a second guide path that guides back into the milling area the ground particles of the milling material classified by the particle classifier as requiring further milling.

2. The mill as claimed in claim 1, wherein said expelling device is situated such that it expels high-velocity gas into the center of the milling chamber.

3. The mill as claimed in claim 2, comprising multiple expelling devices so that the milling material is ground by means of the collisions of streams of high velocity gas expelled from the multiple expelling devices into the center of the milling chamber.

4. The mill as claimed in claim 2, further comprising a member against which the high-velocity gas expelled from the expelling devices collides, such that the milling material is ground by means of the collision between the high-velocity gas expelled from the expelling devices and the member.

5. A mill, comprising:

a milling chamber;

an expelling device that expels high-velocity gas into the milling chamber to grind a milling material in a prescribed milling area;

a particle classifier that classifies the ground particles of the milling material and returns back into the milling chamber the ground particles of the milling material that are not of desired size, said particle classifier being located such that it faces the milling chamber; and a partition that divides the milling chamber into a first guide path that guides the particles of the milling material that are ground at the milling area into the particle classifier and a second guide path that guides back into the milling area the ground particles of the milling material classified by the particle classifier as requiring further milling, wherein said expelling device is situated such that the high-velocity gas is expelled toward a surrounding wall of the milling chamber.

6. A mill as claimed in claim 5, further comprising a member against which the high-velocity gas expelled from the expelling device collides, such that the milling material is ground by means of the collision between the high-velocity gas expelled from the expelling device and the member.

7. A mill as claimed in claim 1, said opening of the expelling device faces the second guide path.

8. The mill as claimed in claim 7, further comprising a collecting member that collects the milling material and guides it to the opening of the expelling device.

9. The mill as claimed in claim 1, said expelling device comprises a Laval-type nozzle.

10. A mill comprising:

a cylindrical milling chamber;

multiple nozzles that expel high-velocity gas into the center of the milling chamber, said multiple nozzles each having an opening that receives a milling material and grinding the milling material by expelling it together with the high-velocity gas;

a particle classifier that classifies the ground particles of the milling material and returns back into the milling chamber the ground particles of the milling material that are not of desired size, said particle classifier being located at the upper area of the milling chamber; and a cylindrical partition that is situated inside the milling chamber such that the axis of the partition is essentially aligned along the axis of the milling chamber, wherein the ground particles of the milling material reach the particle classifier through the interior of the partition, and the ground particles of the milling material classified by the particle classifier as requiring further milling are led to the opening of each nozzles passing outside the partition.

11. The mill as claimed in claim 10, said partition has an inner diameter that is one-half to two-thirds of an inner diameter of the milling chamber.

12. The mill as claimed in claim 10, further comprising a member against which the high-velocity gas expelled from the multiple nozzles collides.

13. The mill as claimed in claim 10, further comprising hoppers that collect the milling material and guide it to the opening of each nozzles.

14. The mill as claimed in claim 10, said nozzles comprise Laval-type nozzles.

15. A mill comprising:

a cylindrical milling chamber;

multiple nozzles that expel high-velocity gas toward a surrounding wall of the milling chamber, said multiple nozzles each having an opening that receives the milling material and grinding the milling material by expelling it together with the high-velocity gas;

a particle classifier that classifies the ground particles of the milling material and returns back into the milling chamber the ground particles of the milling material that are not of desired size, said particle classifier being located in the upper area of the milling chamber; and a cylindrical partition that is situated inside the milling chamber such that the axis of the partition is essentially aligned along the axis of the milling chamber, wherein the ground particles of the milling material reach the particle classifier through the outside of the partition and the ground particles of the milling material classified by the particle classifier as requiring further milling are led to the opening of each nozzles passing through the interior of the partition.

16. The mill as claimed in claim 15, further comprising members against which the high-velocity gas expelled from the multiple nozzles collides.

17. The mill as claimed in claim 15, further comprising hoppers that collect the milling material and guide it to the opening of each nozzles.

18. The mill as claimed in claim 15, said nozzles comprise Laval-type nozzles.

* * * * *